US007573912B2

(12) United States Patent
Lindblom

(10) Patent No.: US 7,573,912 B2
(45) Date of Patent: Aug. 11, 2009

(54) NEAR-TRANSPARENT OR TRANSPARENT MULTI-CHANNEL ENCODER/DECODER SCHEME

(75) Inventor: Jonas Lindblom, Göteborg (SE)

(73) Assignee: Fraunhofer-Gesellschaft zur Foerderung der Angewandten Forschunng E.V., Munich (DE)

( * ) Notice: Subject to any disclaimer, the term of this patent is extended or adjusted under 35 U.S.C. 154(b) by 863 days.

(21) Appl. No.: 11/080,775

(22) Filed: Mar. 14, 2005

(65) Prior Publication Data

US 2006/0190247 A1 Aug. 24, 2006

Related U.S. Application Data

(60) Provisional application No. 60/655,216, filed on Feb. 22, 2005.

(51) Int. Cl.
*H04H 20/28* (2008.01)

(52) U.S. Cl. ..... 370/487; 370/252; 381/22; 381/23

(58) Field of Classification Search ..... 370/252, 370/253, 474, 486, 487, 490; 381/22–23; 375/265; 704/500–504; 700/94
See application file for complete search history.

(56) References Cited

U.S. PATENT DOCUMENTS

| | | | | |
|---|---|---|---|---|
| 7,394,903 | B2 * | 7/2008 | Herre et al. | 381/23 |
| 2006/0009225 | A1 * | 1/2006 | Herre et al. | 455/450 |
| 2007/0140499 | A1 * | 6/2007 | Davis | 381/23 |
| 2007/0162278 | A1 * | 7/2007 | Miyasaka et al. | 704/201 |

FOREIGN PATENT DOCUMENTS

| | | | |
|---|---|---|---|
| EP | 1 376 538 | A1 | 1/2004 |
| WO | 03/085654 | A1 | 10/2003 |
| WO | 03/090207 | A1 | 10/2003 |
| WO | 03/090208 | A1 | 10/2003 |
| WO | 2004/008806 | A1 | 1/2004 |

OTHER PUBLICATIONS

Herre, et al.: "Spatial Audio Coding-an Enabling Technology for Bitrate-Efficient and Compatible Multi-Channel Audio Broadcasting", XP-002350799, IBC Conference Papers, Sep. 9, 2004, 12 pgs.
Fuchs: "Improving Joint Stereo Audio Coding by Adaptive Inter-Channel Prediction," Universität Hannover, Germany, 4 pgs.
Van der Waal, et al.: "Subband Coding of Stereophonic Digital Audio Signals," Philips Research Laboratories, Eindhoven, The Netherlands, 1991 IEEE, pp. 3601-3604.

(Continued)

*Primary Examiner*—Ricky Ngo
*Assistant Examiner*—Gary Mui
(74) *Attorney, Agent, or Firm*—Laurence A. Greenberg; Werner H. Stemer; Ralph E. Locher

(57) ABSTRACT

A multi-channel encoder/decoder scheme additionally preferably generates a waveform-type residual signal. This residual signal is transmitted together with one or more multi-channel parameters to a decoder. In contrast to a purely parametric multi-channel decoder, the enhanced decoder generates a multi-channel output signal having an improved output quality because of the additional residual signal.

29 Claims, 9 Drawing Sheets

OTHER PUBLICATIONS

Johnston, et al.: "Sum-Difference Stereo Transform Coding," AT&T Bell Laboratories, 1992 IEEE, pp. II-569 to II-572.
Lin, et al.: "A Kaiser Window Approach for the Design of Prototype Filters of Cosine Modulated Filterbanks," IEEE Signal Processing Letters, vol. 5, No. 6, Jun. 1998, pp. 132-134.
Hedelin, et al.: "Vector Quantization Based on Gaussian Mixture Models," IEEE Transactions on Speech and Audio Processing, vol. 8, No. 4, Jul. 2000, pp. 385-401.
Baumgarte, et al.: "Binaural Cue Coding-Part I: Psychoacoustic Fundamentals and Design Principles," IEEE Transactions on Speech and Audio Processing, vol. 11, No. 6, Nov. 2003, pp. 509-519.
Subramaniam, et al.: "PDF Optimized Parametric Vector Quantization of Speech Line Spectral Frequencies," IEEE Transactions on Speech and Audio Processing, vol. 11, No. 2, Mar. 2003, pp. 130-142.
Lindblom, et al.: "Variable-Dimension Quantization of Sinusoidal Amplitudes Using Gaussian Mixture Models," Göteborg, Sweden, 2004 IEEE, pp. I-153 to I-156.
"Method for the Subjective Assessment of Intermediate Quality Level of Coding Systems," recommendation ITU-R BS. 1534, 2001, pp. 1-17.
Brandenburg: "MP3 and AAC Explained," AES 17$^{th}$ International Conference, 1999, pp. 99-110.
Herre, et al.: "Intensity Stereo Coding," AES 96$^{th}$ Convention, Feb. 1994, Amsterdam, pp. 1-10.
Fuchs: "Improving MPEG Audio Coding by Backward Adaptive Linear Stereo Prediction," AES 99$^{th}$ Convention, Oct. 1995, New York, 27 pgs.
Herre, et al.: "MP3 Surround: Efficient and Compatible Coding of Multi-Channel Audio," AES 116$^{TH}$ Convention, May 2004, Berlin, Germany, pp. 1-14.
Breebaart, et al.: "High-Quality Parametric Spatial Audio Coding at Low Bitrates," AES 116$^{th}$ Convention, May 2004, Berlin, Germany, pp. 1-13.
Laakso, et al.: "Splitting the Unit Delay," IEEE Signal Processing Magazine, Jan. 1996, pp. 31-60.
Faller: "Parametric Coding of Spatial Audio," No. 3062, 2004, pp. 1-163.
Faller, et al.: "Binaural Cue Coding-Part II: Schemes and Applications," IEEE Transactions on Speech and Audio Processing, vol. 11, No. 6, Nov. 2003, pp. 520-531.

* cited by examiner

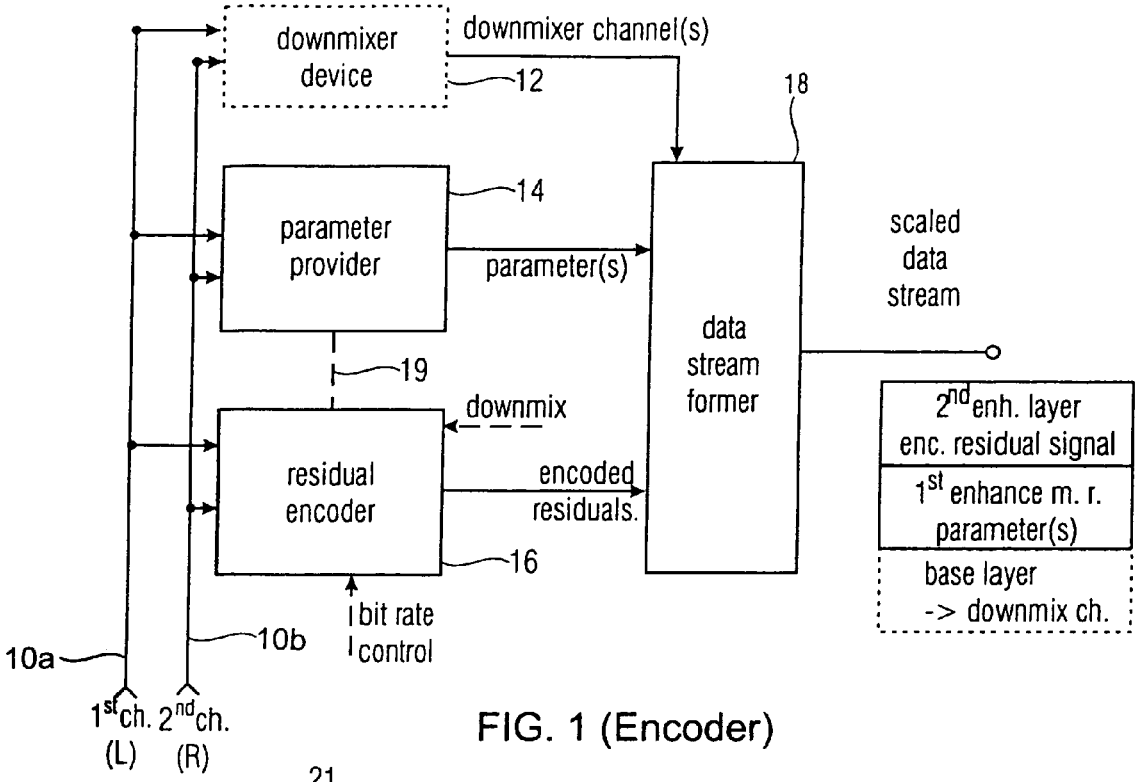
FIG. 1 (Encoder)
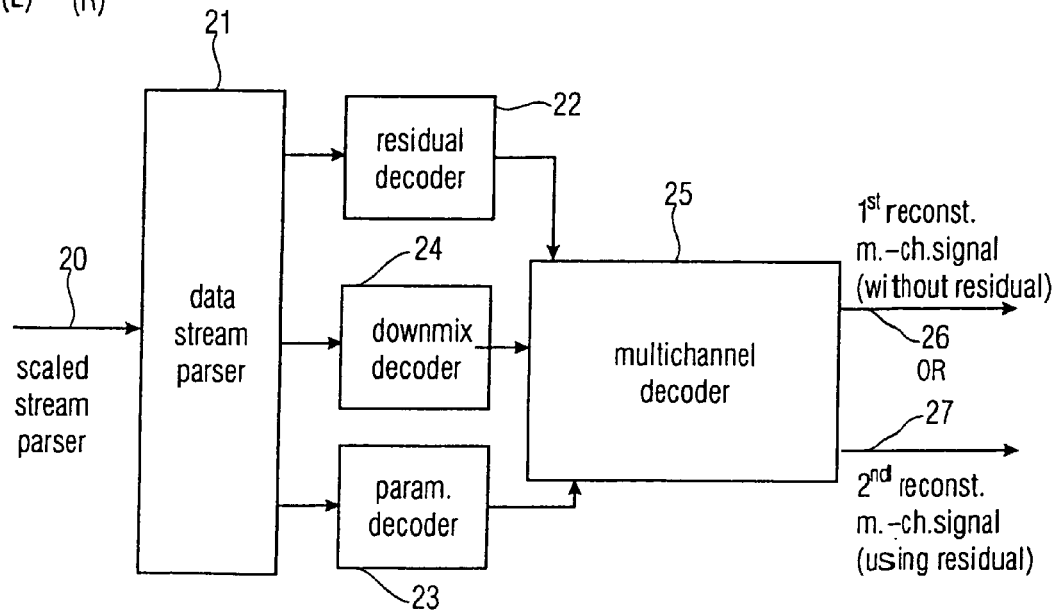
FIG. 2 (Decoder)

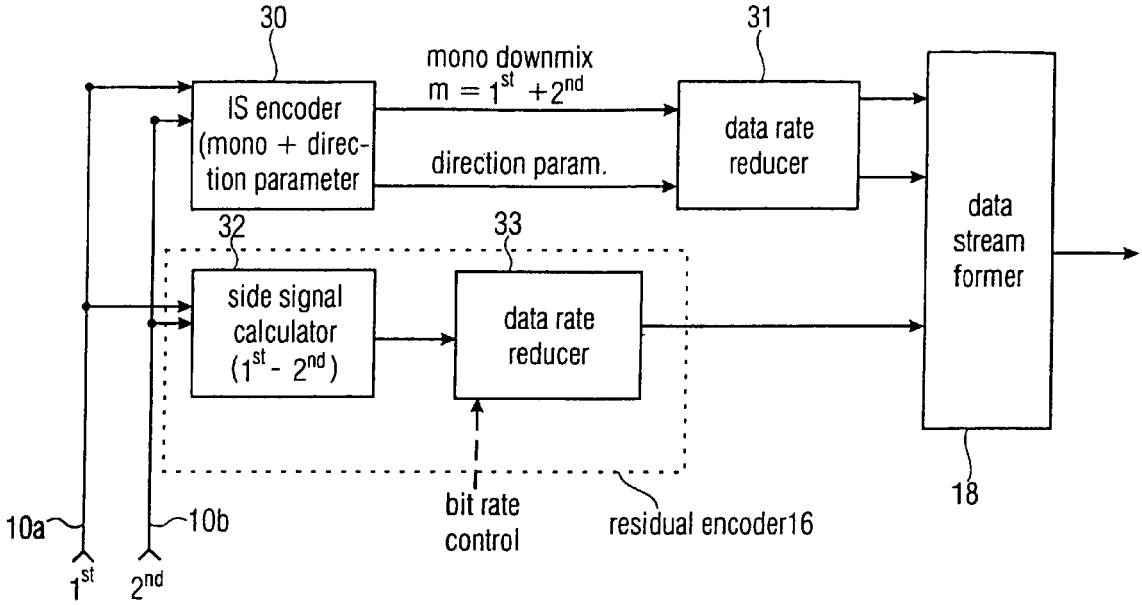
FIG. 3 (Encoder)
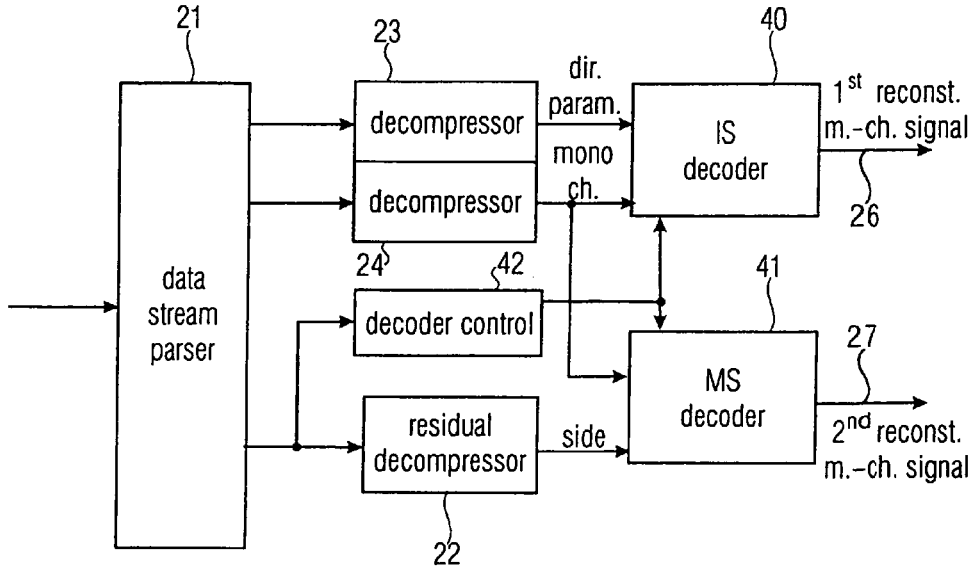
FIG. 4 (Decoder)

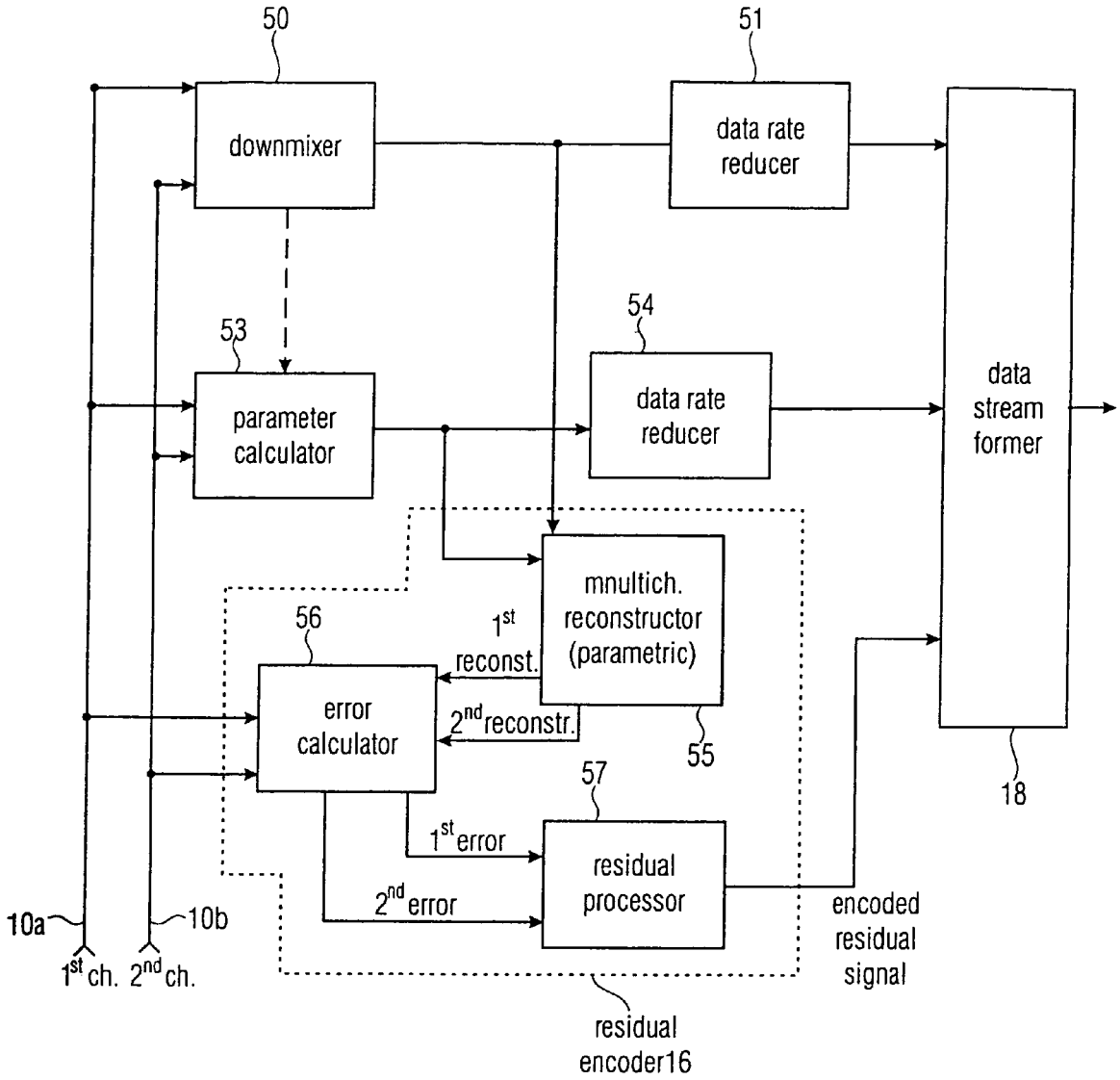
FIG. 5 (Encoder)

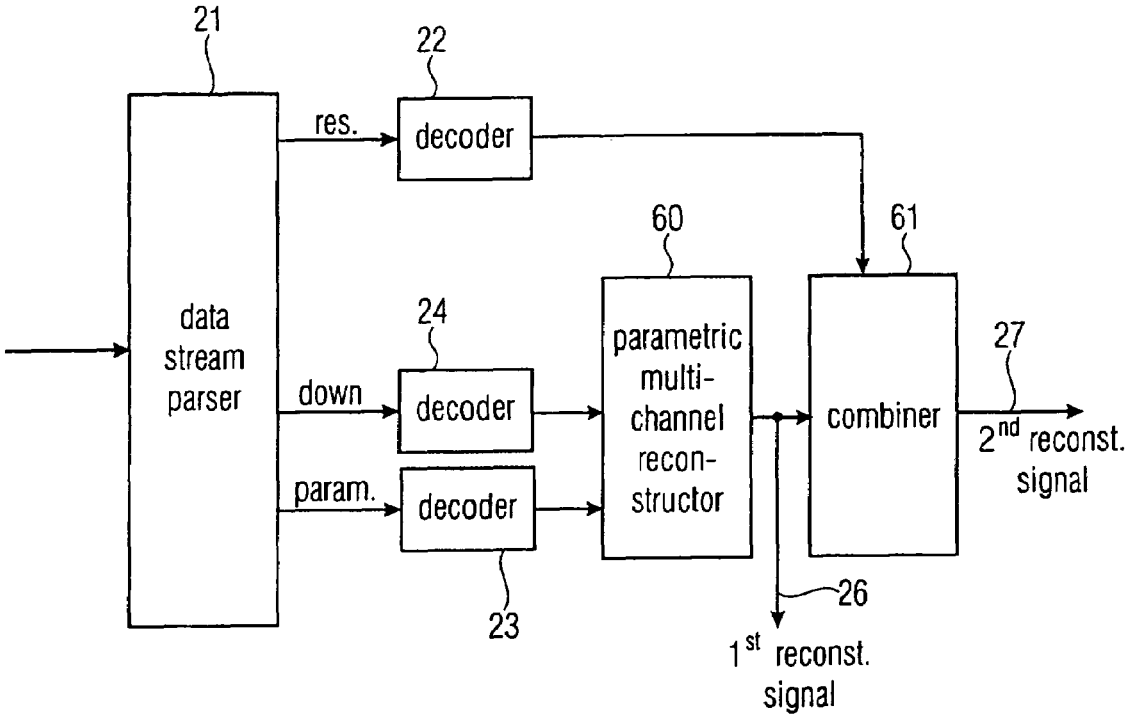
FIG. 6 (Decoder)

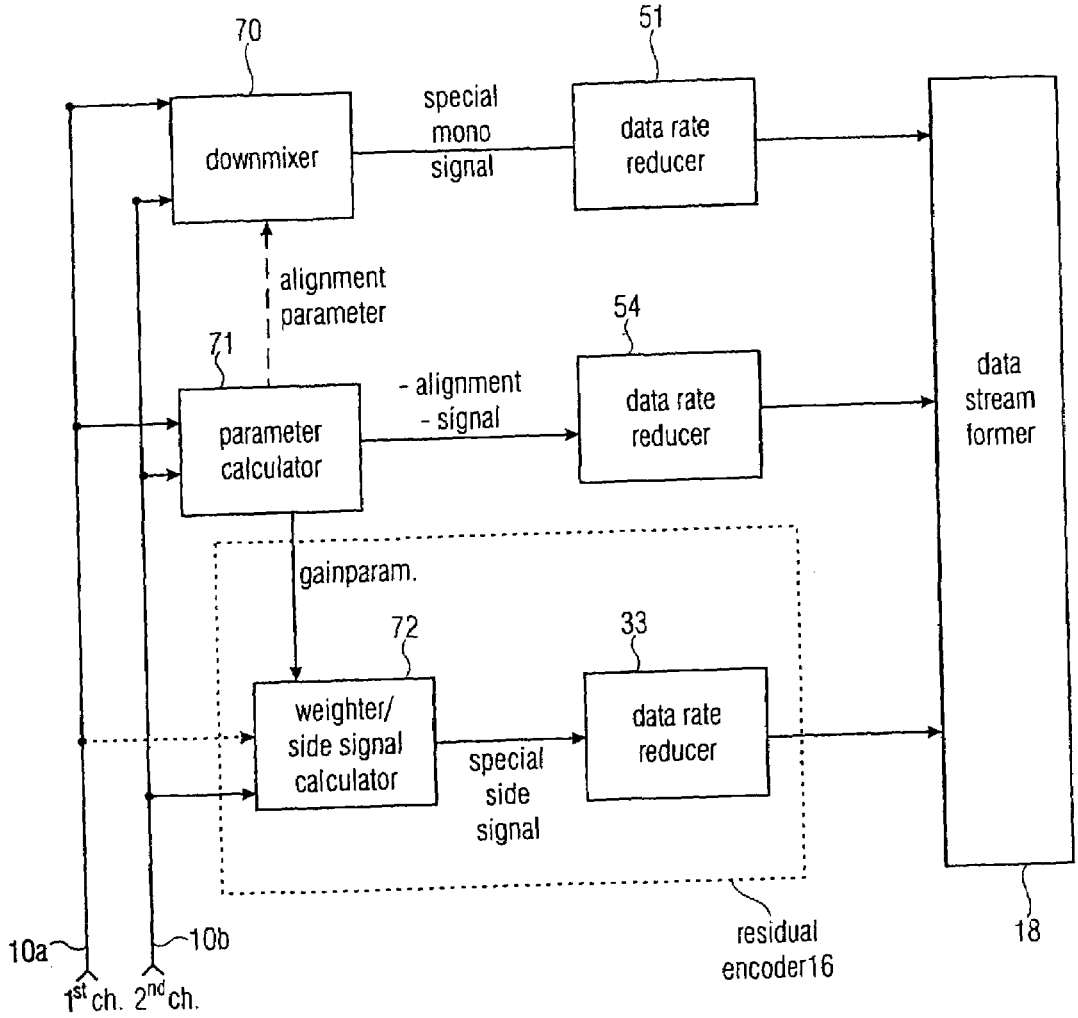
FIG. 7 (Encoder)

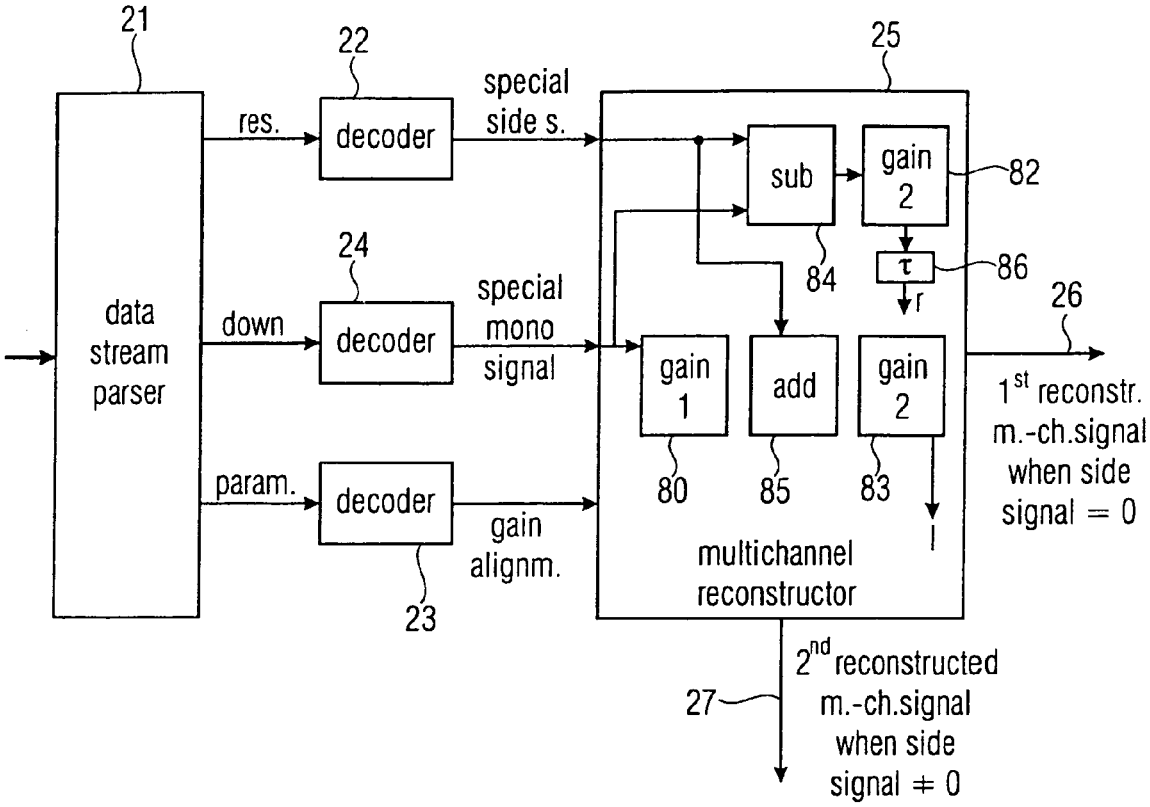
FIG. 8 (Decoder)

$$m(n) = l(n) + r_a(n)$$
$$d(n) = l(n) - g(n)r_a(n)$$

FIG. 9C $$r_a(n) = \frac{m(n) - d(n)}{1 + g(n)}$$

$$l(n) = \frac{g(n)m(n) + d(n)}{1 + g(n)}$$

FIG. 9D

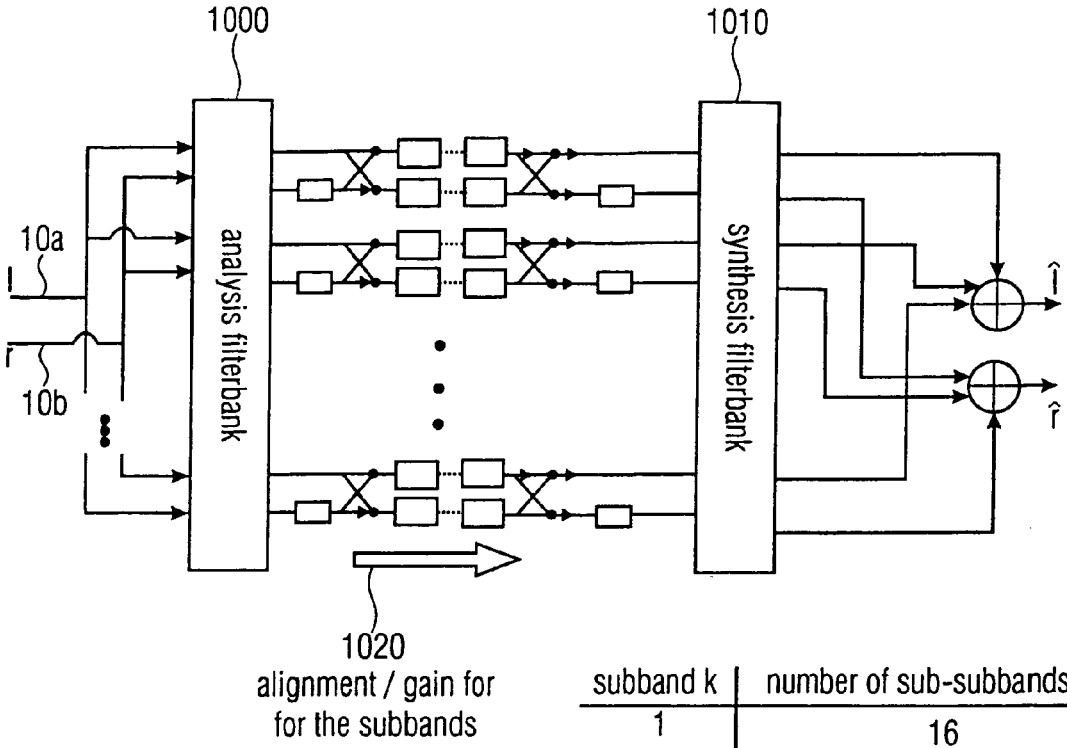
| subband k | number of sub-subbands $M_k$ |
|---|---|
| 1 | 16 |
| 2 | 8 |
| 3-4 | 4 |
| 5-8 | 1 |
FIG. 10
FIG. 11
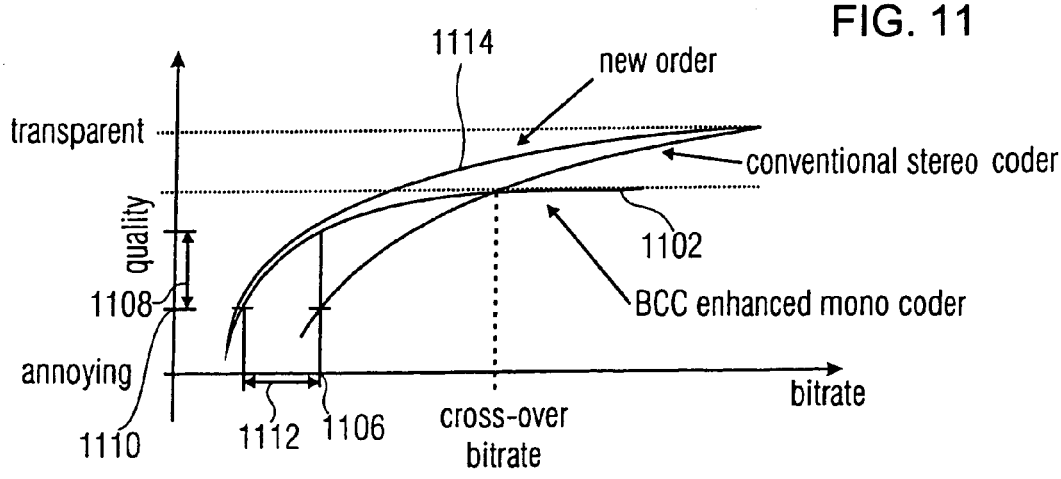

NEAR-TRANSPARENT OR TRANSPARENT MULTI-CHANNEL ENCODER/DECODER SCHEME

CROSS-REFERENCE TO RELATED APPLICATION

This application claims the benefit of U.S. provisional application No. 60/655,216, filed Feb. 22, 2005, the disclosure of which is incorporated herewith in its entirety.

FIELD OF THE INVENTION

The present invention relates to multi channel coding schemes and, in particular, to parametric multi channel coding schemes.

BACKGROUND OF THE INVENTION AND PRIOR ART

Today, two techniques dominate for exploiting the stereo redundancy and irrelevancy contained in stereophonic audio signals. Mid-Side (M/S) stereo coding, primarily aims at redundancy removal, and is based on the fact that since the two channels are often fairly correlated, it is better to encode the sum, and the difference between the two. More bits (relatively) can then be spent on the high power sum signal, than on the low power side (or difference) signal. Intensity stereo coding, on the other hand, achieves irrelevancy removal by, in each subband, replacing the two signals by a sum signal and an azimuth angle. At the decoder, the azimuth parameter is used to control the spatial location of the auditory event represented by the subband sum signal. Mid-Side, and Intensity stereo are both used extensively in existing audio coding standards.

A problem with the M/S approach towards redundancy exploitation, is that if the two components are out of phase (one is delayed relative the other), the M/S coding gain vanishes. This is a conceptual problem, since time delays are frequent in real audio signals. For example, spatial hearing relies much on time differences between signals (especially at low frequencies)). In audio recordings, time delays may stem from both stereophonic microphone setups, and from artificial post processing (sound effects) . In Mid-Side coding, an ad-hoc solution is often used for the time delay issue: M/S coding is only employed when the power of the difference signal is less than a constant factor of that of the sum signal. The alignment problem is better addressed in an article to H. Fuchs, entitled "Improving Joint Stereo Audio Coding by Adaptive Inter-Channel Prediction", Proc. of IEEE Workshop on Applications of Signal Processing to Audio and Acoustics, 1993, pp. 39 - 42, where one of the signal components is predicted from the other. The prediction filters are derived on a frame-by-frame basis in the encoder, and are transmitted as side information. In another article to H. Fuchs, entitled "Improving MPEG Audio Coding by Backward Adaptive Linear Stereo Prediction", Preprint 4086, 99 $^{th}$ AES Convention, 1995, a backward adaptive alternative is considered. It is noted that the performance gain is heavily dependent on the signal type, but for certain types of signals, a dramatic gain compared to M/S stereo coding is obtained.

Parametric stereo coding has received much attention lately. Based on a core mono (single channel] coder, such parametric schemes extract the stereo (multi channel) component, and encode it separately at a relatively low bitrate. This can be seen as a generalization of Intensity stereo coding. Parametric stereo coding methods are particularly useful in the low bitrate range of audio coding, where it results in a significant increase in quality of spending only a small part of the total bit budget on the stereo component. Parametric methods are also attractive since they are extendible to the multi channel (more than two channels) case, and have the ability to offer backward compatibility: MP3 surround is one such example where the multi channel data is encoded and transmitted in the auxiliary field of the data stream. This allows receivers without multi channel capabilities to decode a normal stereo signal, whereas surround enabled receivers can enjoy multi channel audio. Parametric methods often rely on extraction and encoding of different psycho acoustical cues, primarily Inter-Channel Level Differences (ICLD's) and Inter-Channel Time Differences (ICTD's). In an article to J. Breebaart et al., entitled "High-Quality Parametric Spatial Audio Coding at Low Bitrates", Preprint 6072, 116$^{th}$ AES Convention, 2004, it is reported that a coherence parameter is important for a natural sounding result. However, parametric methods are limited in the sense that at higher bit rates, the coders are not able to reach transparent quality due to the inherent modeling constraint.

The problems related to parametric multi channel encoders are that their maximum obtainable quality value is limited to a threshold, which is significantly below the transparent quality. The parametric quality threshold is shown at 1100 in FIG. 11. As can be seen from a schematic curve representing the quality/bitrate dependence of a BCC enhanced mono coder (1102), the quality can not cross the parametric quality threshold 1100 irrespective of the bitrate. This means that even with an increased bitrate, the quality of such a parametric multi channel encoder cannot increase anymore.

The BCC enhanced mono coder is an example for the currently existing stereo coders or multi channel coders, in which a stereo-downmix or a multi channel downmix is performed. Additionally, parameters are derived describing inter channel level relations, inter channel time relations, inter channel coherence relations etc.

The parameters are different from a waveform signal such as a side signal of a Mid/Side encoder, since the side signal describes a difference between two channels in a waveform-style format compared to the parametric representation, which describes similarities or dissimilarities between two channels by giving a certain parameter rather than a sample-wise waveform representation. While parameters require a low number of bits for being transmitted from an encoder to a decoder, waveform-descriptions, i.e., residual signals being derived in a waveform-style require more bits and allow, in principle, a transparent reconstruction.

FIG. 11 shows a typical quality/bitrate dependence of such a waveform-based conventional stereo coder (1104). It becomes clear from FIG. 11, that, by increasing the bitrate more and more, the quality of the conventional stereo coder such as a Mid/Side stereo coder increases more and more until the quality reaches the transparent quality. There is a kind of a "cross-over bitrate", at which the characteristic curve 1102 for the parametric multi channel coder and the curve 1104 for the conventional waveform-based stereo coder cross each other.

Below this cross-over bitrate, the parametric multi channel encoder is much better than the conventional stereo coder. When the same bitrate for both encoders is considered, the parametric multi channel coder provides a quality, which is higher than the quality of the conventional waveform-based stereo coder by the quality difference 1108. Stated in other words, when one wishes to have a certain quality 1110, this quality can be achieved using the parametric coder by a bitrate which is reduced by a difference bitrate 1112 compared to a conventional waveform-based stereo coder.

Above the cross-over bitrate, however, the situation is completely different. Since the parametric coder is at its maximum parametric coder quality threshold 1100, a better quality can only be obtained by using a conventional waveform-based stereo coder using the same number of bits as in the parametric coder.

SUMMARY OF THE INVENTION

It is the object of the present invention to provide an encoding/decoding scheme allowing increased quality and reduced bitrate compared to existing multi channel encoding schemes.

In accordance with the first aspect of the present invention this object is achieved by a multi-channel encoder for encoding an original multi-channel signal having at least two channels, comprising: parameter provider for providing one or more parameters, the one or more parameters being formed such that a reconstructed multi-channel signal can be formed using one or more downmix channels derived from the multi-channel signal and the one or more parameters; residual encoder for generating an encoded residual signal based on the original multi-channel signal, the one or more downmix channels or the one or more parameters so that the reconstructed multi-channel signal when formed using the residual signal is more similar to the original multi-channel signal than when formed without using the residual signal; and data stream former for forming a data stream having the residual signal and the one or more parameters.

In accordance with a second aspect of the present invention, this object is achieved by a multi-channel decoder for decoding an encoded multi-channel signal having one or more downmix channels, one or more parameters and an encoded residual signal, comprising: a residual decoder for generating a decoded residual signal based on the encoded residual signal; and a multi-channel decoder for generating a first reconstructed multi-channel signal using one or more downmix channels and the one or more parameters, wherein the multi-channel decoder is further operative for generating a second reconstructed multi-channel signal using the one or more downmix channels and the decoded residual signal instead of the first reconstructed multi-channel signal or in addition to the first multi-channel signal, wherein the second reconstructed multi-channel signal is more similar to an original multi-channel signal than the first reconstructed multi-channel signal.

In accordance with a third aspect of the present invention, this object is achieved by a multi-channel encoder for encoding an original multi-channel signal having at least two channels, comprising: a time aligner for aligning a first channel and a second channel of the at least two channels using an alignment parameter; a downmixer for generating a downmix channel using the aligned channels; a gain calculator for calculating a gain parameter not equal to one for weighting an aligned channel so that the difference between the aligned channels is reduced compared to a gain value of 1; and a data stream former for forming a data stream having information on the downmix channel, information on the alignment parameter and information on the gain parameter.

In accordance with a fourth aspect of the present invention, this object is achieved by a multi-channel decoder for decoding an encoded multi-channel signal having information on one or more downmix channels, information on a gain parameter, and information on an alignment parameter, comprising: a downmix channel decoder for generating a decoded downmix signal; and a processor for processing the decoded downmix channel using the gain parameter to obtain a first decoded output channel and for processing the decoded downmix channel using the gain parameter and to de-align using the alignment parameter to obtain a second decoded output channel.

Further aspects of the present invention include corresponding methods, data streams/files and computer programs.

The present invention is based on the finding that the problems related to conventional parametric encoders and waveform-based encoders are addressed by combining parametric encoding and waveform-based encoding. Such an inventive encoder generates a scaled data stream having, as a first enhancement layer, an encoded parameter representation, and having, as a second enhancement layer, an encoded residual signal, which is, preferably, a waveform-style signal. Generally, an additional residual signal, which is not provided in a pure parametric multi channel encoder allows to improve the achievable quality in particular between the cross-over bitrate in FIG. 11 and the maximum transparent quality. As can be seen in FIG. 11, even below the cross-over bitrate, the inventive coder algorithm outperforms a pure parametric multi channel encoder with respect to quality at comparable bitrates. Compared to a fully waveform-based conventional stereo encoder, however, the inventive combined parameter/waveform-encoding/decoding scheme is much more bit-efficient. Stated in other words, the inventive devices optimally combine the advantages of parametric encoding and waveform-based encoding so that, even above the cross-over bitrate, the inventive coder profits from the parametric concept, but outperforms the pure parametric coder.

Depending on certain embodiments, the advantages of the present invention outperform the prior art parametric coder or conventional waveform-based multi channel encoder more or less. More advanced embodiments provide a better quality/bitrate characteristic, while low-level embodiments of the present invention require less processing power in the encoder and/or decoder side, but, because of the additionally encoded residual signals, allow a better quality than a pure parametric encoder, since the quality of the pure parametric encoder is limited by the threshold quality 1100 in FIG. 11.

The inventive encoding/decoding scheme is advantageous in that it is able to move seamlessly from pure parametric encoding to waveform-approximating or perfect waveform-transparent coding.

Preferably, parametric stereo coding and Mid/Side stereo coding are combined into a scheme that has the ability to converge towards transparent quality. In this preferred Mid/Side stereo-related scheme, the correlation between the signal components, i.e., the left channel and the right channel are more efficiently exploited.

In general, the inventive idea can be applied in several embodiments to a parametric multi channel encoder. In one embodiment, the residual signal is derived from the original signal without using the parameter information also available at the encoder. This embodiment is preferable in situations, where processing power and, possibly, energy consumption of the processor are an issue. Such a situation can occur in hand-held devices having restricted power possibilities such as mobile phones, palm tops, etc. The residual signal is only derived from the original signal and does not rely on a downmix or the parameters. Therefore, on the decoder side, the first reconstructed multi channel signal, which is generated using the down-mix channel and the parameters is not used for generating the second reconstructed multi channel signal.

Nevertheless, there is some redundancy in the parameters on the one hand and the residual signal on the other hand. A redundancy-reduction can be obtained by other encoders/decoder systems, which, for calculating the encoded residual signal, make use of the parameter information available at the encoder and, optionally, also of the down-mix channel, which might also be available at the encoder.

Depending on the certain situation, the residual encoder can be an analysis by synthesis device calculating a complete reconstructed multi channel signal using the down-mix channel and the parameter information. Then, based on the reconstructed signal, a difference signal for each channel can be generated so that a multi channel error representation is obtained, which can be processed in different manners. One way would be to apply another parametric multi channel encoding scheme to the multi channel error representation. Another possibility would be to perform a matrixing scheme for down-mixing the multi channel error representation. Another possibility would be to delete the error signals from the left and right surround channels and to only encode the center channel error signal or, in addition, to also encode the left channel error signal and the right channel error signal.

Thus, many possibilities exist for implementing a residual processor based on an error representation.

The above-mentioned embodiment allows high flexibility for scalably encoding the residual signal. It is, however, quite processing-power demanding, since a complete multi channel reconstruction is performed at the encoder and an error representation for each channel of the multi channel signal is to be generated and input into the residual processor. On the decoder-side, it is necessary to firstly calculate the first reconstructed multi channel signal and then, based on the decoded residual signal, which is any representation of the error signal, the second reconstructed signal has to be generated. Thus, irrespective of the fact, whether the first reconstructed signal is to be output or not, it has to be calculated on the decoder-side.

In another preferred embodiment of the present invention, the analysis by synthesis approach on the encoder-side and the calculation of the first reconstructed multi channel signal, irrespective of the fact, whether it is to be output or not, are replaced by a straight-forward encoder-side calculation of the residual signal. This is based on a weighted original channel, which depends on a multi channel parameter or is based on a kind of a modified down-mix which again depends on an alignment parameter. In this scheme, the additional information, i.e., the residual signal is non-iteratively calculated using the parameters and the original signals, but not using the one or more down-mix channels.

This scheme is very efficient on the encoder and decoder sides. When the residual signal is not transmitted or has been stripped off from a scaleable data stream because of bandwidth requirements, the inventive decoder automatically generates a first reconstructed multi channel signal based on the down-mix channel and the gain and alignment parameters, while, when a residual signal not equal to zero is input, the multi channel reconstructor does not calculate the first reconstructed multi channel signal, but only calculates the second reconstructed multi channel signal. Thus, this encoder/decoder scheme is advantageous in that it allows for a quite efficient calculation on the encoder side as well as the decoder side, and uses the parameter representation for reducing the redundancy in the residual signal so that a very processing power-efficient and bitrate-efficient encoding/decoding scheme is obtained.

BRIEF DESCRIPTION OF THE DRAWINGS

Preferred embodiments of the present invention are described in detail with respect to the attached Figures, in which:

FIG. 1 is a block diagram of a general representation of the inventive multi channel encoder;

FIG. 2 is a block diagram of a general representation of a multi channel decoder;

FIG. 3 is a block diagram of a low processing power encoder-side embodiment;

FIG. 4 is a block diagram of a decoder embodiment for the FIG. 3 encoder system;

FIG. 5 is a block diagram of an analysis-by-synthesis-based encoder embodiment;

FIG. 6 is a block diagram of a decoder embodiment corresponding to the FIG. 5 encoder embodiment;

FIG. 7 is a general block diagram of a straight-forward encoder embodiment having reduced redundancy in the encoded residual signal;

FIG. 8 is a preferred embodiment of a decoder corresponding to the FIG. 7 encoder;

FIG. 9*c* is a set of equations used on the encoder-side in FIG. 9*a* and FIG. 9*b;*

FIG. 9*d* is a set of equations used on the decoder-side in FIG. 9*a* and FIG. 9*b;*

FIG. 10 is an analysis filterbank/synthesis filterbank based embodiment of the FIG. 9*a* to FIG. 9*d* scheme; and FIG. 11 illustrates a comparison of a typical performance of parametric and conventional waveform-based encoders and the inventive enhanced encoder.

DETAILED DESCRIPTION OF THE PREFERRED EMBODIMENTS

Figure 9A:
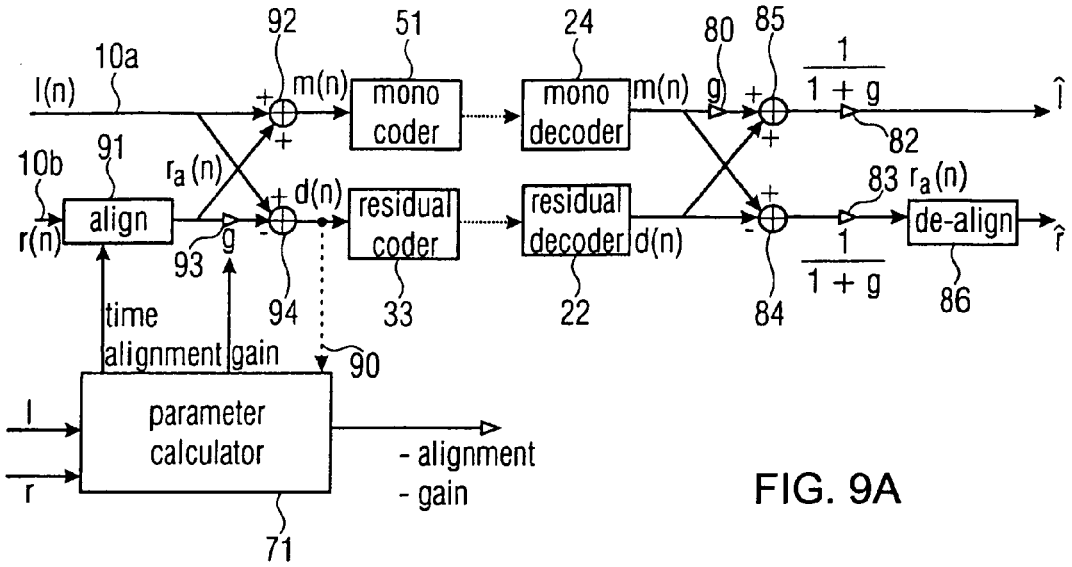
FIG. 9*a* is a preferred embodiment of an encoder/decoder scheme based on the FIG. 7 and FIG. 8 concept.

FIG. 1 shows a preferred embodiment of a multi channel encoder for encoding an original multi channel signal having at least two channels. The first channel may be a left channel 10*a*, and the second channel may be a right channel 10*b* in a stereo environment. Although the inventive embodiments are described in the context of a stereo scheme, the extension to a multi channel scheme is straight-forward, since a multi channel representation having for example five channels has several pairs of a first channel and a second channel. In the context of a 5.1 surround scheme, the first channel can be the front left channel, and the second channel can be the front right channel. Alternatively, the first channel can be the front left channel, and the second channel can be the center channel. Alternatively, the first channel can be the center channel and the second channel can be the front right channel. Alternatively, the first channel can be the rear left channel (left surround channel), and the second channel can be the rear right channel (right surround channel).

An inventive encoder can include a down-mixer 12 for generating one or more down-mix channels. In the stereo-environment, the down-mixer 12 will generate a single down-mix channel. In a multi channel environment, however, the down-mixer 12 can generate several down-mix channels. In a 5.1 multi channel environment, the down-mixer 13 preferably generates two down-mix channels. Generally, the number of down-mix channels is smaller than the number of channels in the original multi channel signal.

The inventive multi channel encoder also includes a parameter provider 14 for providing one or more parameters, the one or more parameters being formed such that a reconstructed multi channel signal can be formed using the one or more down-mix channels derived from the multi-channel signal and the one or more parameters.

Importantly, the inventive multi channel encoder further includes a residual encoder 16 for generating an encoded residual signal. The encoded residual signal is generated based on the original multi channel signal, the one or more down-mix channels or the one or more parameters. Generally, the encoded residual signal is generated such that the reconstructed multi channel signal when formed using the residual signal is more similar to the original multi channel signal than when formed without the residual signal. Thus, the encoded residual signal allows that the decoder generates a reconstructed multi channel signal having a higher quality than the parametric quality threshold 1100 shown in FIG. 11. The one or more parameters and the encoded residual signal are input into a data stream former 18, which forms a data stream having the residual signal and the one or more parameters. Preferably, the data stream output by the data stream former 18 is a scaled data stream having a first enhancement layer including information on the one or more parameters and a second enhancement layer including information on the encoded residual signal. As it is known in the art, the different scaling layers in a scaled data stream can be decoded individually so that a low-level device such as a pure-parametric decoder is in the position to decode the scaled data stream by simply ignoring the second enhancement layer.

In one embodiment of the present invention, the scaled data stream further includes, as a base layer, the one or more down-mix channels. The present invention, is, however, also applicable in an environment, in which the user is already in the possession of the down-mix channel. This situation can occur, when the down-mix channel is a mono or stereo signal, which the user has already received via another transmission channel or via the same transmission channel but earlier compared to the reception of the first enhancement layer and the second enhancement layer. When there is a separate transmission of the down-mix channel(s) and the first and second enhancement layers, the encoder does not necessarily have to include the down-mixer 12. This situation is indicated by the dashed line of the down-mixer block.

Additionally, the parameter provider 14 does not necessarily have to actually calculate the parameters based on the first and the second original channel. In situations, in which the parameters for a certain channel signal already exists, it is sufficient to provide the already generated parameters to the FIG. 1 encoder so that these parameters are supplied to the data stream former 18 and to the residual encoder to be optionally used for calculation of the residual signal and to be introduced into the scaled data stream. Preferably, however, the residual encoder additionally, uses the parameters as shown by a dashed connecting line 19.

In a preferred embodiment of the present invention, the residual encoder 16 can be controlled via a separate bitrate control input. In this case, the residual encoder comprises a certain lossy encoder such as a quantizer having a controllable quantizer step size. When a large quantizer step size is signaled via the bitrate control input, the encoded residual signal will have a smaller value range (the largest quantization index output by the quantizer) compared to a case, in which a smaller quantizer step size is signaled via the bitrate control input. The large quantizer step size will result in a lower bit demand for the encoded residual signal and, therefore, will result in a scaled data stream having a reduced bitrate compared to the case, in which the quantizer within the residual encoder 16 has a smaller quantizer step size resulting in an encoded residual signal needing more bits.

Strictly speaking, the above remarks apply to scalar quantization. Generally stated, however, it is preferred to use an encoder having controllable resolution, which is based on a vector quantization technique. When the resolution is high, more bits are required for encoding the residual signal compared to the case, in which the resolution is low.

FIG. 2 shows a preferred embodiment of an inventive multi channel decoder, which can be used in connection with the FIG. 1 encoder. In particular, FIG. 2 shows a multi channel decoder for decoding an encoded multi channel signal having one or more down-mix channels, one or more parameters and an encoded residual signal. All this information, i.e., the down-mix channel, the parameters and the encoded residual signals are included in a scaled data stream 20 input into a data stream parser which extracts the encoded residual signal from the scaled data stream 20 and forwards the encoded residual signal to a residual decoder 22. Analogously, the one ore more preferably encoded down-mix channels are provided to a down-mix decoder 24. Additionally, the preferably encoded one or more parameters are provided to a parameter decoder 23 to provide the one or more parameters in a decoded form. The information output by the blocks 22, 23 and 24 are input into a multi channel decoder 25 for generating a first reconstructed multi channel signal 26 or a second reconstructed multi channel signal 27. The first reconstructed multi channel signal is generated by the multi channel decoder 25 using the one or more down-mix channels and the one or more parameters, but not using the residual signal. The second reconstructed multi channel signal 27, however, is generated using the one or more down-mix channels and the decoded residual signal. Since the residual signal includes additional information, and, preferably, waveform information, the second reconstructed multi channel signal 27 is more similar to an original multi channel signal (such as channels 10*a* and 10*b* of FIG. 1) than the first reconstructed multi channel signal.

Depending on the certain implementation of the multi channel decoder 25, the multi channel decoder 25 will output either the first reconstructed channel 26 or the second reconstructed multi channel signal 27. Alternatively, the multi channel decoder 25 calculates the first reconstructed multi channel signal in addition to the second reconstructed multi channel signal. Naturally, in all implementations the multi channel decoder 25 will only output the first reconstructed multi channel signal, when the scaled data stream includes the encoded residual signal. When, however, the scaled data stream is processes on its way from the encoder to the decoder by stripping the second enhancement layer, the multi channel decoder 25 will only output the first reconstructed multi channel signal. Such stripping of the second enhancement layer may take place, when there was a transmission channel on the way between the encoder and the decoder, which had highly limited bandwidth resources so that a transmission of the scale data stream was only possible without the second enhancement layer.

FIG. 3 and FIG. 4 illustrate one embodiment of the inventive concept, which requires only a reduced processing power on the encoder side (FIG. 3) as well as on the decoder side (FIG. 4). The FIG. 3 encoder includes an intensity stereo encoder 30, which outputs a mono down-mix signal on the one hand and parametric intensity stereo direction information on the other hand. The mono down-mix, which is preferably formed by adding the first and the second input channel are input into a data rate reducer 31. For the mono down-mix channel, the data rate reducer 31 may include any of the well-known audio encoders such as an MP3 encoder, an AAC encoder or any other audio encoder for mono signals. For the parametric direction information, the data rate reducer 31 may include any of the known encoders for parametric information such as a difference encoder, a quantizer and/or an entropy encoder such as a Huffman encoder or an arithmetic encoder. Thus, blocks 30 and 31 of FIG. 3 provide the functionalities schematically illustrated by blocks 12 and 14 of the FIG. 1 encoder.

The residual encoder 16 includes a side signal calculator 32 and a subsequently applied data rate reducer 33. The side signal calculator 32 performs a side signal calculation known from prior art Mid/Side stereo encoders. One preferred example is a sample-wise difference calculation between the first channel 10*a* and the second channel 10*b* to obtain a waveform-type side signal, which is, then, input into the data rate reducer 33 for data rate compression. The data rate reducer 33 can include the same elements as outlined above with respect to the data rate reducer 31. At the output of block 33, an encoded residual signal is obtained, which is input into the data stream former 18 so that a preferably scaled data stream is obtained.

The data stream output by block 18 now includes, in addition to the mono down-mix, parametric intensity stereo direction information as well as a waveform-type encoded residual signal.

The data rate reducer 31 can be controlled by a bitrate control input as already discussed in connection with FIG. 1. In another embodiment, the data rate reducer 33 is arranged for generating a scaled output data stream which has, in its base layer, a residual encoded with a low number of bits per sample, and which has, in its first enhancement layer, a residual encoded with a medium number of bits per sample, and which has, in its next enhancement layer, a residual encoded with an again higher number of bits per sample. For the base layer of the data rate reducer output, one can, for example, use 0.5 bits per sample. For the first enhancement layer one can use for example 4 bits for sample, and for the second enhancement layer, one can use, for example, 16 bits per sample.

A corresponding decoder is shown in FIG. 4. The data stream input into the data stream parser 21 is parsed to separately output parameter information to the decompressor 23. The encoded down-mix information is input into the decompressor 24, and the encoded residual signal is input into the residual decompressor 22. The FIG. 4 decoder further includes a straight-forward intensity stereo decoder 40 and, in addition, a Mid/Side decoder 41. Both decoders 40 and 41 perform the functions of the multi channel decoder 25 to output the first reconstructed multi channel signal 26, which is solely generated by the intensity stereo decoder 40, and to output the second reconstructed multi channel signal 27, which is solely generated by the MS decoder 41.

When the data stream includes an encoded residual signal, the straight-forward implementation in FIG. 4 would output the first reconstructed multi channel 26 as well as the second reconstructed multi channel signal. Naturally, only the better second reconstructed multi channel signal 27 is interesting for the user in this situation. Therefore, a decoder control 42 can be provided for sensing, whether there is an encoded residual signal in the data stream. When it is sensed, that no such encoded residual signal is in the data stream, the decoder control 42 is operative to deactivate the mid/side decoder 40 to save processing power and, therefore, battery power which is especially useful in a low-power hand-held device such as a mobile phone etc.

FIG. 5 shows another embodiment of the present invention, in which the encoded residual signal is generated on the basis of an analysis-by-synthesis approach. Again, the first and the second channels 10*a*, 10*b* are input into a downmixer 50, which is followed by a data rate reducer 51. At the output of block 51, a preferably compressed downmix signal having one or more downmix channels is obtained and supplied to the data stream former 18. Thus, blocks 50 and 51 provide the functionality of the downmixer device 12 of FIG. 1. Additionally, the first and the second input channels 10*a*, 10*b* are supplied to a parameter calculator 53 and the parameters output by the parameter calculator are forwarded to another data rate reducer 54 for compressing the one or more parameters. Thus, blocks 53 and 54 provide the same functionality as the parameter provider 14 in FIG. 1.

In contrast to the FIG. 3 embodiment, however, the residual encoder 16 is more sophisticated. In particular, the residual encoder 16 includes a parametric multi-channel reconstructor 55. The multi-channel reconstructor generates, for the two-channel example, a first reconstructed channel and a second reconstructed channel. Since the parametric multi-channel reconstructor only uses the downmix channels and the parameters, the quality of the reconstructed multi-channel signal output by block 55 will correspond to curve 1102 in FIG. 11 and will always be below the parametric threshold 1100 in FIG. 11.

The reconstructed multi-channel signal is input into an error calculator 56. The error calculator 56 is operative to also receive the first and the second input channel 10*a* and 10*b*, and outputs a first error signal and a second error signal. Preferably, the error calculator calculates a sample-wise difference between an original channel and a corresponding reconstructed channel (output block 55). This procedure is performed for each pair of original channel and reconstructed channel. The output of the error calculator 56 is—again—a multi-channel representation, but now, in contrast to the original multi-channel signal, a multi-channel error signal. This multi-channel error signal having the same number of channels as the original multi-channel signal is input into a residual processor 57 for generating the encoded residual signal.

There exist numerous implementations of the residual processor 57, which all depend on bandwidth requirements, required degree of scalability, quality requirements, etc.

In one preferred implementation, the residual processor 57 is again implemented as a multi-channel encoder generating one or more error downmix channels and error downmix parameters. This embodiment can be said to be a kind of an iterative multi-channel encoder, since the residual processor 57 might include blocks 50, 51, 53 and 54.

Alternatively, the residual processor 57 can be operative to only select a single or two error channels from its input signal, which have the highest energy and to only process the highest energy error signal to obtain the encoded residual signal. In addition or instead of this criterion, more advanced criteria can be used which are based on perceptually more motivated error measures. Alternatively, the residual processor might include a matrixing scheme for downmixing the input channels into one ore more downmix channels so that a corresponding decoder-device would perform an analogue dematrixing procedure. The one or more downmix channels can then be processed using elements of a well-known mono or stereo encoder or can be completely processed using one of the above-mentioned mono/stereo encoders to obtain the encoded residual signal.

A decoder for the FIG. 5 encoder is shown in FIG. 6. Compared to the FIG. 2 embodiment, FIG. 6 reveals that the multi-channel decoder 25 includes a parametric multi-channel reconstructor 60 and a combiner 61. The parametric multi-channel reconstructor 60 generates the first reconstructed multi-channel signal 26 only based on a decoded downmix and decoded parameter information. The first reconstructed signal 26 can be output, when no encoded residual signal is included in the data stream. When, however, an encoded residual signal is included in the data stream, the first reconstructed signal is not output but input into a combiner 61 for combining the parametrically reconstructed multi-channel signal 26 to the decoded residual signal which is one of the representations of the error representation at the output of the error calculator 56 of FIG. 5 as discussed above. The combiner 61 combines the decoded residual signal, i.e., any representation of the error signal and the parametrically reconstructed multi-channel signal to output the second reconstructed signal 27. When the FIG. 6 decoder is considered with respect to FIG. 11, it becomes clear that, for a certain bitrate, the first reconstructed signal has a quality determined by line 1102 while the second reconstructed signal 27 has a higher quality determined by the line 1114 for the same bitrate.

The FIG. 5/FIG. 6 embodiment is preferable to the FIG. 3/FIG. 4 embodiment, since the redundancy in the encoded residual signal is reduced. However, the FIG. 5/FIG. 6 embodiment requires a higher amount of processing power, storage, battery resources and algorithmic delay.

A preferred compromise between the FIG. 3/FIG. 4 embodiment and the FIG. 5/FIG. 6 embodiment is subsequently described with reference to FIG. 7 as to an encoder representation and FIG. 8 as to a decoder representation. The encoder includes a certain downmixer 74 for performing a downmix using the first and the second input channels 10*a*, 10*b*. In contrast to a simple downmix, which is generated by only adding both original channels 10*a*, 10*b* to obtain a mono signal, the downmixer 70 is controlled by an alignment parameter generated by a parameter calculator 71. Here, both input channels 10*a*, 10*b*, are time-aligned to each other before both signals are added to each other. In this way, a special mono signal is obtained at the output of the downmixer 70, which mono signal is different from a mono signal for example generated by a low-level intensity stereo encoder as shown at 30 in FIG. 3.

In addition to the alignment parameter or instead of the alignment parameter, the parameter calculator 71 is operative to generate a gain parameter. The gain parameter is input into a weighter device 72 to preferably weight the second channel 10*b* using the gain parameter, before a side signal calculation is performed. Weighting the second channel before calculating the waveform-like difference between the first and the second channel results in a smaller residual signal, which is shown as the special side signal input into any suitable data rate reducer 33. The data rate reducer 33 shown in FIG. 7 can be exactly implemented as the data rate reducer 33 shown in FIG. 3.

The FIG. 7 embodiment is different from the FIG. 3 embodiment in that parameter information is accounted for preferably in the downmixer 70 as well as the residual signal calculation so that the residual signal output by the data rate reducer 33 in FIG. 7 can be represented by a lower number of bits than the signal output by data rate reducer 33. This is due to the fact that the FIG. 7 residual signal includes less redundancy than the FIG. 3 residual signal.

FIG. 8 shows a preferred embodiment of a decoder-implementation corresponding to the encoder-implementation in FIG. 7. Contrary to the FIG. 6 decoder, the multi-channel reconstructor 25 is operative to automatically output the first reconstructed multi-channel signal 26, when the side signal, i.e., the residual signal is zero or to automatically output the second reconstructed multi-channel signal 27, when the residual signal is not equal to zero. Thus, the FIG. 8 multi-channel reconstructor 25 cannot output both signals 26 and 27 simultaneously, but can only output a first one of the two signals or a second one of the two signals. Thus, the FIG. 8 embodiment does not require any decoder control such as shown in FIG. 4.

In particular, the residual signal decoder 22 in FIG. 8 outputs the special side signal as generated by element 72 of the corresponding encoder in FIG. 7. Additionally, the downmix decoder 24 outputs the special mono signal as generated by the downmixer 70 in FIG. 7.

Then, the special side signal and the special mono signal are input into the multi-channel decoder together with the gain parameter and the time alignment parameter. The gain parameter is operative to control the gain stage 84 applying a gain in accordance with a first gain rule. Additionally, the gain parameter controls additional gain stages 82, 83 for applying a gain in accordance with a different second gain rule. Additionally, the multi-channel reconstructor includes a subtractor 84 and an adder 85 as well as a time de-alignment block 86 to generate a reconstructed first channel and a reconstructed second channel.

Subsequently, reference is made to a preferred embodiment of the FIG. 7 and FIG. 8 encoder/decoder scheme. FIG. 9*a* shows a complete encoder/decoder scheme in accordance with an aspect of the present invention, in which the residual signal d(n) is not equal to zero. Additionally, FIG. 9*b* indicates the FIG. 9*a* scalable encoder/decoder, when no difference signal d(n) has been calculated, or when the data stream has been stripped off to reduce the residual signal e.g. because of a transmission bandwidth related requirement. In case of stripping off the encoded residual signal from the data stream transmitted from an encoder to a decoder in the FIG. 9*a* embodiment, the FIG. 9*a* embodiment becomes a pure parametric multi-channel scenario, in which the alignment parameter and the gain parameter are the multi-channel parameters, and the special mono signal is the downmix channel transmitted from an encoder-side to a decoder-side.

The multi-channel reconstruction on the decoder-side is performed using only the alignment and gain parameters, since no residual signal is received at the decoder-side, i.e., d(n) equals zero.

FIG. 9*c* shows the equations underlying the inventive encoder, while FIG. 9*d* indicates the equation underlying the inventive decoder.

In particular, the inventive encoder includes, as a parameter provider 14 from FIG. 1, the parameter calculator 71. The parameter calculator 71 is operative to calculate a time alignment parameter for aligning the right channel r(n) to the left channel 1(n). In FIG. 9*a* to FIG. 9*d*, the aligned right channel is indicated by $r_a(n)$. The alignment parameter is preferably extracted from overlapping blocks of the input signal. The alignment parameter corresponds to a time delay between the left channel and the right channel and is estimated preferably using time domain cross correlation techniques. For the case, when there is no alignment gain in a subband, for example in the case of independent signals, the delay parameter is set to zero. Preferably, one delay (time-alignment) parameter is estimated per subband in a subband structure. In a preferred embodiment, a fixed analysis rate of 46 ms and 50% overlapping Hamming windows have been employed.

The parameter calculator 71 further calculates the gain value. The gain value is also preferably extracted from overlapping blocks of the signal. Normally, the gain parameter is identical to the level difference parameter commonly used in parametric coding such as the well-known binaural cue coding scheme. Alternatively, the gain value can be calculated using an iterative approach, in which the difference signal is fed back to the parameter calculator, and the gain value is set such that the difference signal reaches a minimum value as shown by a dashed line 90 in FIG. 9*a*. As soon as the parameter alignment and gain are calculated, the downmixer 70 in FIG. 7 as well as the residual encoder 16 in FIG. 7 can be started. In particular, the downmixer 70 in FIG. 7 includes an alignment block 91 for delaying one channel by the calculated time alignment parameter. The delayed second channel $r_a(n)$ is then added to the first channel using an adder device 92. At the output of the adder 92, the downmix channel is present. Thus, the downmixer 70 in FIG. 7 includes blocks 91 and 92 to form the special mono signal.

The residual encoder 16 in FIG. 7 further includes the weighter 93 and the subsequent side signal calculator 94, which calculates the difference between the original first channel and the aligned and weighted second channel. In particular, for weighting the aligned second channel, the first weighting rule used in a corresponding decoder-side block 80 is performed. Thus, the residual encoder 16 includes the alignment device 91, the weighting device 93 and the side signal calculator 94. Since the aligned second channel is used for the downmix as well as the residual calculation, it is sufficient to calculate the aligned right channel only once and to forward the result to the downmixer 70 as well as to the weighter/side signal calculator 72 in FIG. 7.

Preferably, the alignment and gain factors are chosen such that the process is reversible so that the FIG. 9*d* equations are well-defined and numerically well-conditioned.

A generic mono coder can be used for mono coder 51 to code the sum signal, and a preferably dedicated residual coder 33 is employed for the residual.

When the mono coder 51 is loss-less, i.e., when the mono signal is not further quantized, and either the residual encoder is also loss-less or the alignment signal model matches the source signal perfectly, then the inventive coding structure shown in FIG. 9*a* has the perfect reconstruction property also assuming that the alignment and gain parameters are only subjected to a loss-less encoding scheme.

Figure 9B:
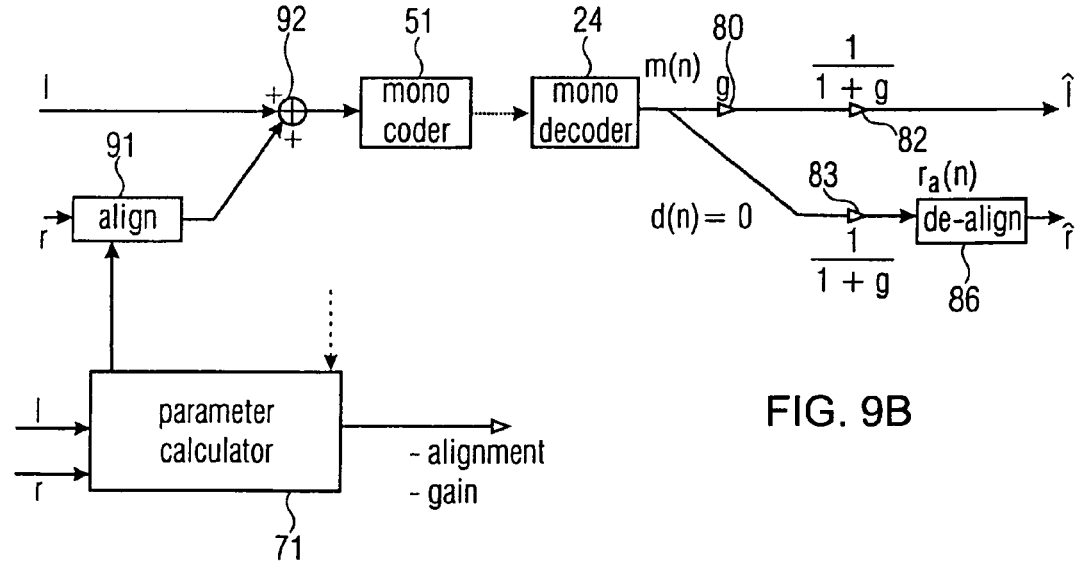
FIG. 9*b* is a preferred embodiment of the FIG. 9*a* embodiment, when no residual signal but only alignment and gain parameters are transmitted.

The inventive system in FIG. 9*a* provides a framework for a scheme that can operate with graceful degradation over a multitude of ranges as indicated in FIG. 11, line 1114. In particular, without residual coding, i.e., d(n)=0, the scheme reduces to parametric stereo coding, by transmitting only the alignment and gain parameters (as multi-channel parameters) in addition to the mono signal (as the Downmix channel). This situation is illustrated in FIG. 9*b*. Additionally, the inventive system has the advantage that the alignment method automatically addresses the mono downmix problem.

Subsequently, reference is made to FIG. 10 illustrating an implementation of the inventive embodiment illustrated in FIGS. 9*a* to 9*d* into a subband coding structure. The original left and right channels are input into an analysis filterbank 1000 for obtaining several subband signals. For each subband signal, an encoding/decoding scheme as shown in FIGS. 9*a* to 9*d* is used. On the decoder-side, reconstructed subband signals are combined in a synthesis filterbank 1010 to finally arrive at the full-band reconstructed multi-channel signals. Naturally, for each subband, an alignment parameter and a gain parameter is to be transmitted from the encoder-side to the decoder-side as illustrated by an arrow 1020 in FIG. 10.

The preferred implementation of the subband coding structure of FIG. 10 is based on a cosine modulated filterbank with two stages, in order to achieve unequal subband bandwidths (on a perceptually motivated scale). The first stage splits the signal into M bands. The M subband signals are critically decimated, and fed to the second stage filterbank. The kth filter of the second stage, $k \in \{1, \ldots, M\}$, has $M_k$ bands. In a preferred implementation, M=8 bands are used, and a sub-subband structure as in the table in FIG. 10, resulting in 36 effective subbands after the two stages is preferred. The prototype filters are designed according to [13] with at least 100 dB damping in the stop band. The filter order in the first stage is 116, and the maximum filter order in the second stage is 256. The coding structure is then applied to subband pairs (corresponding to left and right subband channels).

The corresponding grouping of the subbands between the first and the second stage filterbank is shown in the table to the right of FIG. 10, which makes clear that the first subband k includes 16 sub-subbands. Additionally, the second subband includes 8 sub-subbands, etc.

Efficient parametric encoding is achieved utilizing Gaussian mixture (GM) vector quantization (VQ) techniques. Quantization based on GM models is popular within the field of speech coding [14-16], and facilitates low-complexity implementation of high dimensional VQ. In a preferred implementation, we vector quantize 36-dimensional vectors of gain and delay parameters. The GM models all have 16 mixture components, and are trained on a database of parameters extracted from 60 minutes of audio data (with varying content, and disjoint from subsequent evaluation test signals). Methods based on explicit statistical models are less frequently used in audio coding than in speech coding. One reason is a disbelief in the ability of statistical models to capture all relevant information contained in general audio. In a preferred case, preliminary evaluation using open and closed test procedures of parameter models do, however, indicate that this is not a problem in this case. The resulting bitrate for the gain and delay parameters is 2.3 kbps.

The subband structure is exploited for coding the residual signals. With the same block processing as described above, the variance in each subband is estimated and the variances are vector quantized using GM VQ across subbands (i.e., one 36-dimensional vector is encoded at a time). The variances facilitate bit allocation among the subbands employing a greedy bit allocation algorithm [17, p. 234]. The subband signals are then encoded using uniform scalar quantizers.

The instantaneous gain g(n) and delay $\tau$ (n) are obtained by linearly interpolation the block estimates. The time varying delay is realized through a $73^{rd}$-order fractional delay filter based on a truncated and Hamming windowed sinc impulse response [18]. The filter coefficients are updated on a per sample basis using the interpolated delay parameter.

A framework for flexible coding of the stereo image in general audio is proposed. With the new structure, it is possible to move seamlessly from a parametric stereo mode, to waveform approximating coding. An example implementation of the ideas was tested, both using an uncoded residual to evaluate the effect of increasing the bitrate of the residual coder, and using a MP3 core coder, in order to evaluate the scheme in a more realistic scenario.

For stabilizing the stereo image, it is preferred to low-pass filter the parameters in a pure parametric system or in a scalable system having a pure parametric part that con be used by a decoder without processing the residual signal, as is done in for example [9]. This reduces the alignment gain of the system. By coding the residual using scalar subband coding, the quality is further increased, and approaches transparent quality. In particular, adding bits to the residual stabilizes the stereo image, and the stereo width is also increased. Furthermore, flexible time segmentation, and variable rate (e.g., bit reservoir) techniques are preferred to better exploit the dynamic nature of general audio. A coherence parameter is preferably included in the alignment filter to enhance the parametric mode. Improved residual coding, employing perceptual masking, vector quantization, and differential encoding, lead to more efficient irrelevancy and redundancy removal.

Although the inventive system has been described in the context of stereo-encoding and in the context of a parametrically enhanced Mid/Side encoding scheme, it is to be noted here that each multi-channel parametric encoding/decoding scheme such as a generalized intensity-stereo kind of encoding can profit from an additionally enclosed side component to finally reach the perfect reconstruction property. Although a preferred embodiment of an inventive encoder/decoder scheme has been described using a time alignment at the encoder-side, transmitting the alignment parameter, and using a time-de-alignment at the decoder side, there exist further alternatives, which perform the time-alignment on the encoder-side for generating a small difference signal, but which do not perform the time de-alignment on the decoder-side so that the alignment parameter is not to be transmitted from the encoder to the decoder. In this embodiment, the neglection of the time de-alignment naturally includes an artifact. However, this artifact is in most cases not so serious so that such an embodiment is especially suitable for low-price multi-channel decoders.

The present invention, therefore, can also be regarded as an extension of a preferably BCC-type parametric stereo coding scheme or any other multi-channel encoding scheme, which completely falls back to a purely parametric scheme, when the encoded residual signal is stripped off. In accordance with the present invention, a purely parametric system is enhanced by transmitting various types of additional information which preferably include the residual signal in a waveform-style, the gain parameter and/or the time alignment parameter. Thus, a decoding operation using the additional information results in a higher quality than what would be available with parametric techniques alone.

Depending on the requirements, the inventive methods of encoding or decoding can be implemented in hardware, software or in firmware. Therefore, the invention also relates to a computer readable medium having store a program code, which when running on a computer results in one of the inventive methods. Thus, the present invention is a computer program having a program code, which when running on a computer results in an inventive method.

The invention claimed is:

1. Multi-channel encoder for encoding an original multi-channel signal having at least two channels, comprising:

a parameter provider for providing one or more parameters, the one or more parameters being formed such that a reconstructed multi-channel signal can be formed using one or more downmix channels derived from the multi-channel signal and the one or more parameters;

a residual encoder for generating an encoded residual signal based on the original multi-channel signal, the one or more downmix channels or the one or more parameters so that the reconstructed multi-channel signal when formed using the residual signal is more similar to the original multi-channel signal than when formed without using the residual signal, the residual encoder including:

a multi-channel decoder for generating a decoded multi-channel signal using the one or more downmix channels and the one or more parameters;

an error calculator for calculating a multi-channel error signal representation based on the decoded multi-channel signal and the original multi-channel signal; and a residual processor for processing the multi-channel error signal representation to obtain the encoded residual signal; and a data stream former for forming a data stream having the encoded residual signal and the one or more parameters.

2. The multi-channel encoder in accordance with claim 1, in which the data stream former is operative to form a scalable data stream, in which the one or more parameters and the residual signal are in different scaling layers.

3. The multi-channel encoder in accordance with claim 1, in which the residual encoder is operative to calculate the encoded residual signal as a waveform residual signal.

4. The multi-channel encoder in accordance with claim 1, in which the residual encoder is operative to generate the residual signal based on the one or more parameters and the original multi-channel signal without the one or more downmix channels so that the residual signal has a smaller energy in comparison to a generation of the residual signal without using the one or more parameters.

5. The multi-channel encoder in accordance with claim 4, in which the parameter provider comprises:

an alignment calculator for calculating a time alignment parameter to be provided to a time aligner for aligning a first channel and a second channel of the at least two channels; or a gain calculator for calculating a gain not equal to 1 for weighting a channel so that a difference between two channels is reduced compared to a gain value of one.

6. The multi-channel encoder in accordance with claim 5, in which the residual encoder is operative to calculate and encode a difference signal derived from a first channel and an aligned or weighted second channel.

7. The multi-channel encoder in accordance with claim 5, further comprising a downmixer for generating a downmix channel using the aligned channels.

8. The multi-channel encoder in accordance with claim 1, further comprising an analysis filterbank for splitting the multi-channel signal into a plurality of frequency bands, wherein the parameter provider and the residual encoder are operative to operate on the subband signals, and wherein the data stream former is operative to collect encoded residual signals and parameters for a plurality of frequency bands.

9. The multi-channel encoder in accordance with claim 1, in which the residual processor includes a multi-channel encoder for generating a multi-channel representation of the multi-channel error signal representation.

10. The multi-channel encoder in accordance with claim 9, in which the residual processor is operative to further generate one or more downmix channels of the multi-channel error signal representation.

11. The multi-channel encoder in accordance with claim 1, in which the parameter provider is operative to provide binaural cue coding (BCC) parameters, the binaural cue coding (BCC) parameters including at least one of inter-channel level differences, inter-channel coherence parameters, inter-channel time differences and channel envelope cues.

12. A method of encoding an original multi-channel signal having at least two channels, comprising:

providing one or more parameters, the one or more parameters being formed such that a reconstructed multi-channel signal can be formed using one or more downmix channels derived from the multi-channel signal and the one or more parameters;

generating an encoded residual signal based on the original multi-channel signal, the one or more downmix channels or the one or more parameters so that the reconstructed multi-channel signal when formed using the residual signal is more similar to the original multi-channel signal than when formed without using the residual signal, wherein generating the encoded residual signal includes the steps of:

generating a decoded multi-channel signal using the one or more downmix channels and the one or more parameters;

calculating a multi-channel error signal representation based on the decoded multi-channel signal and the original multi-channel signal; and processing the multi-channel error signal representation to obtain the encoded residual signal; and forming a data stream having the encoded residual signal and the one or more parameters.

13. A computer readable medium having stored thereon a computer program operative, when executed on a computer, to perform the method of claim 12.

14. A multi-channel decoder for decoding an encoded multi-channel signal having one or more downmix channels, one or more parameters and an encoded residual signal, the one or more downmix channels depending on an alignment parameter or depending on a gain parameter, the multi-channel decoder comprising:

a residual decoder for generating a decoded residual signal based on the encoded residual signal; and a multi-channel decoder for generating a first reconstructed multi-channel signal using one or more downmix channels and the one or more parameters, wherein the multi-channel decoder is further operative for generating a second reconstructed multi-channel signal using the one or more downmix channels and the decoded residual signal the multi-channel decoder being further operative to perform at least one of:

weighting the downmix channel using the gain parameter;

adding the decoded residual signal to a weighted downmix channel and again weighting a resulting channel to obtain the first reconstructed multi-channel signal;

subtracting the decoded residual signal from the downmix channel and weighting a channel resulting from the subtraction using the gain parameter; or when the one or more downmix channels depend on the alignment parameter, de-aligning a difference between the downmix channel and the decoded residual signal when obtaining the second reconstructed multi-channel signal.

15. The multi-channel decoder in accordance with claim 14, wherein the encoded multi-channel signal is represented by a scaled data stream, said scaled data stream having a first scaling layer including the one or more parameters and a second scaling layer including the encoded residual signal, wherein the multi-channel encoder further comprises:

a data stream parser for extracting the first scaling layer or the second scaling layer.

16. The multi-channel decoder in accordance with claim 14, wherein, the encoded residual signal depends on the one or more parameters; and the multi-channel decoder is operative to use the one or more downmix channels, the one or more parameters and the decoded residual signal for generating the second reconstructed multi-channel signal.

17. The multi-channel decoder in accordance with claim 14, wherein, the downmix channel depends on an alignment parameter; and the multi-channel decoder is operative to weight the downmix channel using a first weighting rule based on the gain parameter and to weight the downmix channel using a second weighting rule using the gain parameter or the multi-channel decoder to de-align one output channel with respect to the other output channel using the alignment parameter.

18. The multi-channel decoder in accordance with claim 14, wherein, the parameters include binaural cue coding (BCC) parameters, said binaural cue coding (BCC) parameters including at least one of inter-channel level differences, inter-channel coherence parameters, inter-channel time differences and channel envelope cues; and the multi-channel decoder is operative to perform a multi-channel decoding operation in accordance with a binaural cue coding (BCC) scheme.

19. The multi-channel decoder in accordance with claim 14, in which the one or more downmix channels, the one or more parameters and the encoded residual signal are represented by subband-specific data, further comprising:

a synthesis filterbank for combining reconstructed subband data generated by the multi-channel decoder to obtain a full-band representation of the first or the second reconstructed multi-channel signal.

20. A method of decoding an encoded multi-channel signal having one or more downmix channels, one or more parameters and an encoded residual signal, comprising:

generating a decoded residual signal based on the encoded residual signal;

generating a first reconstructed multi-channel signal using one or more downmix channels and the one or more parameters, and a second reconstructed multi-channel signal using the one or more downmix channels and the decoded residual signal;

the generating step including at least one of:

weighting the downmix channel using the gain parameter;

adding the decoded residual signal to a weighted downmix channel and again weighting a resulting channel to obtain the first reconstructed multi-channel signal;

subtracting the decoded residual signal from the downmix channel and weighting a channel resulting from the subtraction using the gain parameter; or when the one or more downmix channels depend on the alignment parameter, de-aligning a difference between the downmix channel and the decoded residual signal when obtaining the second reconstructed multi-channel signal.

21. A computer readable medium having stored thereon a computer program operative, when executed on a computer, to perform the method of claim 20.

22. A multi-channel encoder for encoding an original multi-channel signal having at least two channels, comprising:

a time aligner for aligning a first channel and a second channel of the at least two channels using an alignment parameter;

a downmixer for generating a downmix channel using the aligned channels;

a gain calculator for calculating a gain parameter not equal to one for weighting an aligned channel so that the difference between the aligned channels is reduced compared to a gain value of 1; and a data stream former for forming a data stream having information on the downmix channel, information on the alignment parameter and information on the gain parameter.

23. The multi-channel encoder in accordance with claim 22, further comprising a residual encoder for calculating and encoding a difference signal derived from the first channel and an aligned and weighted second channel, wherein the data stream former is further operative to include an encoded residual signal into the data stream.

24. A multi-channel decoder for decoding an encoded multi-channel signal having information on one or more downmix channels, information on a gain parameter, information on an alignment parameter, and information on an encoded residual signal, the multi-channel decoder comprising:

a downmix channel decoder for generating a decoded downmix channel;

a processor for processing the decoded downmix channel using the gain parameter to obtain a first decoded output channel and for processing the decoded downmix channel using the gain parameter and to de-align using the alignment parameter to obtain a second decoded output channel;

a residual decoder for generating a decoded residual signal; and said processor being operative to:

primarily weight the downmix channel using the gain parameter;

add the decoded residual signal and perform a secondary weighting using the gain parameter to obtain a first reconstructed channel;

subtract the decoded residual signal from the downmix channel before weighting; and de-align to obtain the reconstructed second channel.

25. A method of encoding an original multi-channel signal having at least two channels, comprising:

time-aligning a first channel and a second channel of the at least two channels using an alignment parameter;

generating a downmix channel using the aligned channels;

calculating a gain parameter not equal to one for weighting an aligned channel so that the difference between the aligned channels is reduced compared to a gain value of 1; and forming a data stream having information on the downmix channel, information on the alignment parameter and information on the gain parameter.

26. A computer readable medium having stored thereon a computer program operative, when executed on a computer, to perform the method of claim 25.

27. A method of decoding an encoded multi-channel signal having information on one or more downmix channels, information on a gain parameter, information on an alignment parameter, and an encoded residual signal, the method comprising:

generating a decoded downmix channel;

processing the decoded downmix channel using the gain parameter to obtain a first decoded output channel and for processing the decoded downmix channel using the gain parameter and a de-alignment based on the alignment parameter to obtain a second decoded output channel;

decoding the encoded residual signal to obtain a decoded residual signal;

the processing step including the steps of:

primarily weighting the downmix channel using the gain parameter;

adding the decoded residual signal and performing a secondary weighting using the gain parameter to obtain a first reconstructed channel;

subtracting the decoded residual signal from the downmix channel before weighting; and de-aligning to obtain the reconstructed second channel.

28. A computer readable medium having stored thereon a computer program operative, when executed on a computer, to perform the method of claim 27.

29. A computer readable medium having stored thereon:

an encoded multi-channel signal having information on one or more downmix channels, on one or more parameters resulting, when combined with the one or more downmix channels, in a first reconstructed multi-channel signal, and an encoded residual signal resulting, when combined with the one or more downmix channel, in a second reconstructed multi-channel signal;

the second reconstructed multi-channel signal being more similar to an original multi-channel signal than the first reconstructed multi-channel signal; and at least one of:

a scalable data stream including the one or more parameters and the residual signal are in different scaling layers; or binaural cue coding (BCC) parameters include at least one of inter-channel level differences, inter-channel coherence parameters, inter-channel time differences and channel envelope cues.

* * * * *